US005206448A

United States Patent [19]

Kunimoto

[11] Patent Number: 5,206,448

[45] Date of Patent: Apr. 27, 1993

[54] MUSICAL TONE GENERATION DEVICE FOR SYNTHESIZING WIND OR STRING INSTRUMENTS

[75] Inventor: Toshifumi Kunimoto, Hamamatsu, Japan

[73] Assignee: Yamaha Corporation, Hamamatsu, Japan

[21] Appl. No.: 640,919

[22] Filed: Jan. 14, 1991

[30] Foreign Application Priority Data

Jan. 16, 1990 [JP] Japan ..... 2-6938

[51] Int. Cl.[5] ..... G10H 5/02

[52] U.S. Cl. ..... 84/659; 84/661; 84/663; 84/627

[58] Field of Search ..... 84/601, 602, 621, 622, 84/626, 627, 633, 661-663, 665, 659, DIG. 10

[56] References Cited

U.S. PATENT DOCUMENTS

| | | | |
|---|---|---|---|
| 3,652,955 | 3/1972 | Cruger et al. | 84/409 |
| 4,130,043 | 12/1978 | Niimi | 84/622 |
| 4,517,553 | 5/1985 | Engstrom | 84/617 X |
| 4,655,115 | 4/1987 | Nishimoto | 84/DIG. 10 X |
| 4,868,869 | 9/1989 | Kramer | 84/622 X |
| 4,875,400 | 10/1989 | Okuda et al. | 84/626 |
| 4,882,965 | 11/1989 | McClish | 84/453 X |
| 5,005,460 | 4/1991 | Suzuki et al. | 84/600 |
| 5,052,268 | 10/1991 | Clark, Jr. | 84/615 |
| 5,063,820 | 11/1991 | Yamada | 84/609 |
| 5,134,919 | 8/1992 | Kunimoto | 84/622 |
| 5,144,096 | 9/1992 | Kunimoto | 84/659 |
| 5,157,218 | 10/1992 | Kunimoto et al. | 84/659 |

FOREIGN PATENT DOCUMENTS

| | | | |
|---|---|---|---|
| 0248527 | 9/1987 | European Pat. Off. . | |
| 0084695 | 3/1990 | Japan | 84/626 |

*Primary Examiner*—Paul Ip
*Assistant Examiner*—Jeffrey W. Donels
*Attorney, Agent, or Firm*—Graham & James

[57] ABSTRACT

A musical tone generation device comprises a musical tone signal generator and a musical tone control device. The musical tone signal generator consists of an excitation circuit and a delay circuit which simulate the musical tone generation mechanism of a musical instrument. This generator has a hysteresis characteristic, so that the generator generates a musical tone signal having the hysteresis characteristic, in accordance with a musical tone control signal. While, the musical tone control device converts the musical tone control signal into other musical tone control signal which nullifies the hysteresis characteristic of the musical tone signal generator. Therefore, the musical tone signal generator generates musical tone signals without the hysteresis characteristic.

11 Claims, 5 Drawing Sheets

7

MUSICAL TONE GENERATION DEVICE FOR SYNTHESIZING WIND OR STRING INSTRUMENTS

BACKGROUND OF THE INVENTION

1. Field of the Invention

This invention relates to musical tone generation devices, and in particular, to musical tone generation devices used for synthesizing and generating musical tones that stimulate the sound of wind instruments, plucked string instruments, rubbed string instruments, and struck string instruments.

2. Prior Art

Electronic musical tone synthesizers using FM (frequency modulation) tone generators are conventionally known. This type of musical tone synthesizer generates an envelope whose amplitude varies over time by means of an envelope generator. This envelope controls tone color amplitude and pitch of musical tones.

Additionally, musical tone synthesizers wherein tone generation is accomplished by simulation of the sound generation mechanism of conventional non-electronic musical instruments have been recently proposed. This kind of musical tone synthesizer consists of a closed-loop circuit incorporating a low-pass filter which simulates the acoustic decay and a delay circuit which simulates the propagation delay of vibration in a conventional non-electronic musical instrument. With this type of tone generator, an excitation signal such as an impulse signal is provided to the closed-loop circuit, wherein the excitation signal circulates.

When above described type of musical tone synthesizer is used to simulate a stringed instrument, the excitation signal circulates within the closed loop once in a duration equivalent to a vibration period of a string in the conventional stringed instrument. The bandwidth of the circulating signal is limited by the low-pass filter. Finally, the circulating signal is extracted from this closed loop and is used as a musical tone signal.

Control of the above described excitation signal can be accomplished by using, for example, an envelope pattern output from an envelope generator. In Japanese Patent Laid-open No. Sho-63-40199 and Japanese Patent Publication No. Sho-58-58679, musical tone synthesizers have been disclosed incorporating a closed loop circuit of the type described above, and wherein the excitation signal supplied to the closed loop is controlled using an envelope pattern output from an envelope generator. An example of volume control in this type of device will be described with reference to the waveform diagrams shown in FIGS. 6(*a*) and 6(*b*). FIG. 6(*a*) shows an envelope pattern output from an envelope generator which is applicable to volume control and the like for musical tones under ordinary circumstances. In FIGS. 6(*a*) and 6(*b*), the vertical axis indicates the output level of the envelope generator and the horizontal axis indicates time. During simulation of a conventional non-electronic instrument, volume control can be suitably carried out using an envelope pattern wherein the output level is initially zero after which it rises to a level of one, and then decays back to a level of zero, as is the case with the example shown in FIG. 6(*a*). Additionally, the pattern shown in FIG. 6(*b*) could suitably be applied to volume control during simulation of a wind instrument. In the case of the envelope shown in FIG. 6(*b*), the output level at the initial attack is somewhat greater than zero, but otherwise, the pattern is essentially the same as the pattern shown in FIG. 6(*a*).

However, the above described devices for simulating the sound generating mechanisms of conventional non-electronic musical instruments are in certain respects inadequate for simulating many types of instruments. Specifically, multiple differing control parameters must be provided at predetermined times for predetermined intervals when simulating, for example, a wind instrument. In fact, even for a relatively simple envelope pattern such as that shown in FIG. 6(*b*), generation of the necessary control parameters in the specified sequence is a considerably complicated problem, to which conventional devices such as those described above are not well suited due to bandwidth limitations, processing speed and other factors.

Furthermore, envelope patterns supplied from the envelope generator in the type of musical tone synthesizer described above produces a response having hysteresis properties similar to those shown in FIG. 7. Thus, when simulating a wind instrument, for example, when simulating increasing blowing pressure, the volume response is that described by the lower curve in FIG. 7, whereas when simulating decreasing blowing pressure, the volume response is that described by the upper curve in FIG. 7. Thus, the volume level corresponding to a given blowing pressure differs depending on whether the blowing pressure is increasing or decreasing. For this reason, there is a large difference between the envelope pattern supplied from the envelope generator and the musical tone actually generated, making it difficult to control the sound volume in a linear manner.

Also, depending on the extent of the hysteresis, sound generation may be perceived as having a delay following a key-on event because the initial volume is abnormally attenuated. This problem is particularly aggravated at low volumes, such that the generated sound may be imperceptible long after tone generation has commenced.

SUMMARY OF THE INVENTION

In view of the above described shortcomings of conventional musical tone generation devices incorporating envelope generators, it is an object of the present invention to provide a tone generation device incorporating a simplified envelope generator, wherein the need for producing complicated control parameters is eliminated and which can more faithfully reproduce the sound of a conventional non-electronic musical instrument.

To achieve the above object, the present invention provides a musical tone generation device wherein envelope patterns can be generated without the need for complicated control parameters and wherein hysteresis characteristics of tone generation signals produced therein can be suitably eliminated, thereby converting tone signals having hysteresis characteristics into tone signals free from hysteresis characteristics. More specifically, the present invention provides a musical tone generation device wherein envelope patterns can be simply generated, the musical tone generation device comprising a musical tone signal generating means for generating musical tone signals in response to the musical tone control signals, the musical tone signal generating means having a hysteresis characteristic between the musical tone signals and the musical tone control signals, and a canceling means for canceling out the hysteresis characteristic of the musical tone signal generating means.

As a result, musical tone signals can be produced free of hysteresis and without the need for complicated control parameters for generation of envelope patterns, whereby the sound of a conventional non-electronic musical instrument can be faithfully reproduced.

DETAILED DESCRIPTION OF THE PREFERRED EMBODIMENTS

Figure 1:
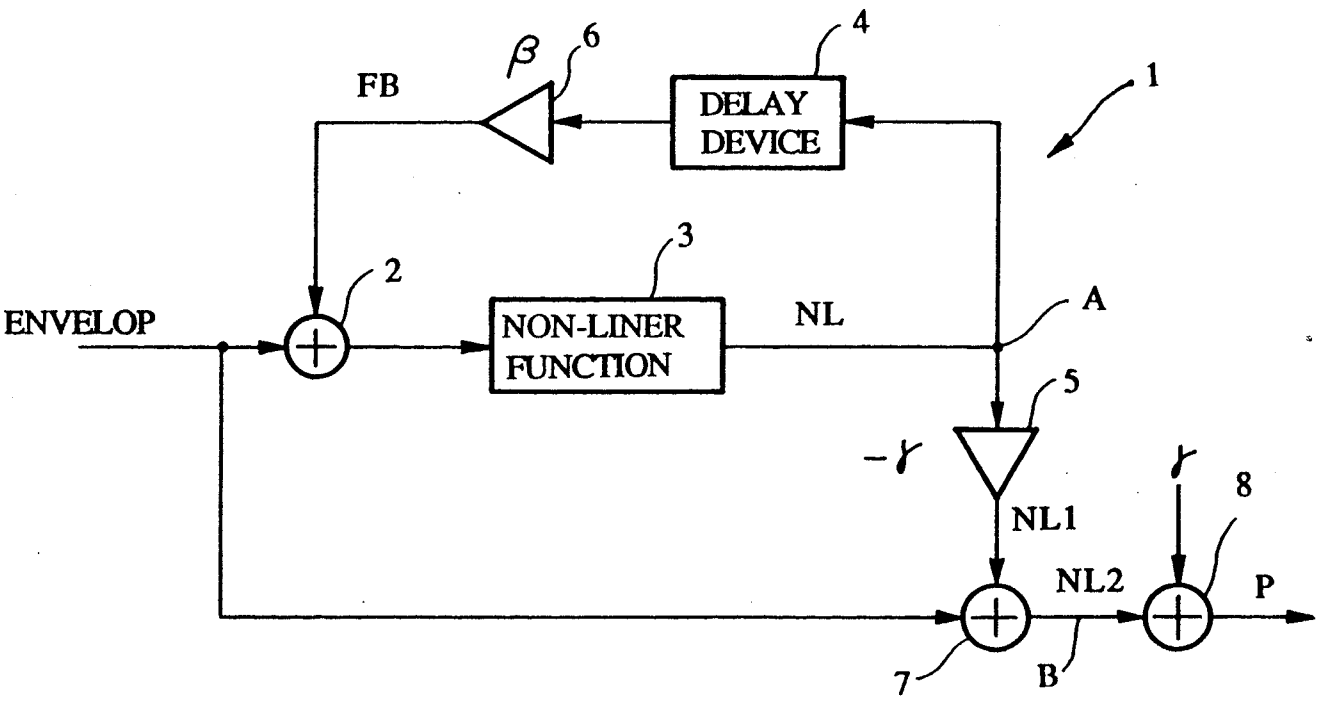
FIG. 1 is a block diagram showing the composition of the musical tone control device (nullifying means) in a preferred embodiment of the present invention.

FIG. 1 is a block diagram showing the configuration of one sample execution of this invention. In this figure, a musical tone control device 1, which nullifies a hysteresis characteristic of the following musical tone synthesizer, consists of an adder 2, a ROM 3, a delay device 4, multipliers 5 and 6, and adders 7 and 8. The adder 2 adds the envelope EL which is supplied from an envelope generator which is not illustrated here and a feedback signal FB to be described later and then outputs it to the ROM (Read Only Memory) 3. The ROM 3 stores a non-linear function shown in FIG. 2 as a table. The non-linear function in this example takes a value from 0 to 1.0, using a value of 1.0 for input signals greater than 1.0. This non-linear function has a maximum slope $\alpha$, which is set to a value from 0 to 1. The output signal NL of this ROM 3 is supplied to the delay device 4 and the multiplier 5. After the delay device 4 delays the output signal NL for a specified duration, it outputs the signal to the multiplier 6. Also, the delay device 4 is reset to 0 when keyed on by an operator (not illustrated here or before) or is reset by momentarily swinging the envelope generator output to a larger negative value.

Then, the multiplier 6 allows the output signal NL to be multiplied by &B (multiplication coefficient) and is output to the adder 2 as a feedback signal FB described above. Then the multiplier 5 multiplies the output signal NL by $-\gamma$ (multiplication coefficient) and is output to the adder 7 as the output signal NL1. The adder 7 adds the envelope EL to the above output signal NL1 and outputs the result to the adder 8 as the output signal NL2. The adder 8 adds $\gamma$ to the output signal NL2 (multiplication factor $\gamma$) and outputs it as an envelope P which is equivalent to the blowing pressure of a wind instrument.

Figure 3A:
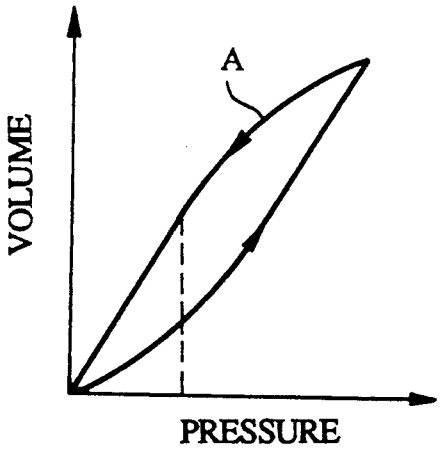
FIGS. 3(*a*) and 3(*b*) are graphs showing hysteresis characteristics.
Figure 3B:
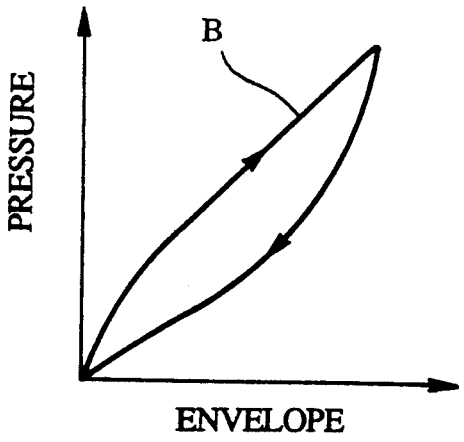
Figure 7:
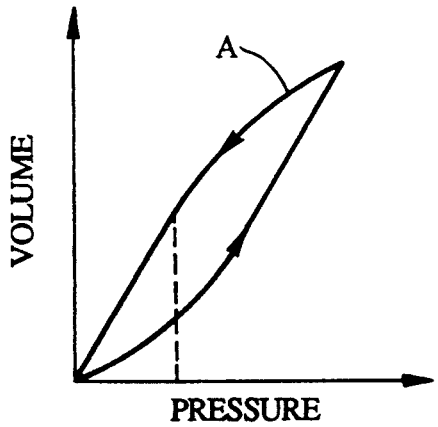
FIG.7 (Prior Art)
FIG. 7 is a graph indicating the hysteresis characteristics of a conventional musical tone synthesizer.

In the above configuration, since the result ($\alpha \cdot \beta$) obtained by multiplying the output signal NL by the multiplication coefficient $\beta$ is greater than 1, the transmission function viewed from the input side at point A in the figure becomes as shown in hysteresis A shown in FIG. 3(*a*) (same as FIG. 7). Also, if the multiplication coefficient $\beta$ becomes large, the output signal NL of the ROM 3 nearly maintains a value of 1 even if the envelope EL is brought back to 0 after starting between 0 and 1. Also, the transfer function viewed from the input side at point B illustrated at the output side of the adder 7 reaches hysteresis B shown in FIG. 3(*b*). This hysteresis B is the inverse of the above hysteresis A, and follows the line at the upper side of the hysteresis cycle on attack and follows the line at the lower side on release. The maximum slope $\alpha$ and the multiplication coefficients $\beta$ and $\gamma$ are set previously in terms of the system's characteristics and creation of timbre, but may be subject to key scaling (the set value is changed according to the musical interval).

Operation of this sample execution in the configuration described above is explained by the waveform diagram FIG. 4 (*a*)–(*c*). Also, the values of the envelope EL, output signal NL, output signal NL2 at point B, and pressure P at the final output at each time t0–t9 are shown in the next Table 1. Also, in this example, the multiplication coefficient $\beta$ is set at 1.0, while the multiplication coefficient $\gamma$ is set at 0.2.

TABLE 1

| t | EL | NL | NL2 | P |
|---|---|---|---|---|
| 0 | 0 | 0 | 0 | 0.2 |
| 1 | 0.25 | 0.25 | 0.2 | 0.4 |
| 2 | 0.5 | 0.75 | 0.35 | 0.55 |
| 3 | 0.75 | 1.0 | 0.55 | 0.75 |
| 4 | 1.0 | 1.0 | 0.8 | 1.0 |
| 5 | 1.0 | 1.0 | 0.8 | 1.0 |
| 6 | 1.0 | 1.0 | 0.8 | 1.0 |
| 7 | 1.0 | 1.0 | 0.8 | 1.0 |
| 8 | 0.5 | 1.0 | 0.3 | 0.5 |
| 9 | 0 | 1.0 | −0.2 | 0 |

The envelope EL shown in FIG. 3(*a*) is supplied to the adders 2 and 7 by the envelope generator, which is not illustrated.

Figure 2:
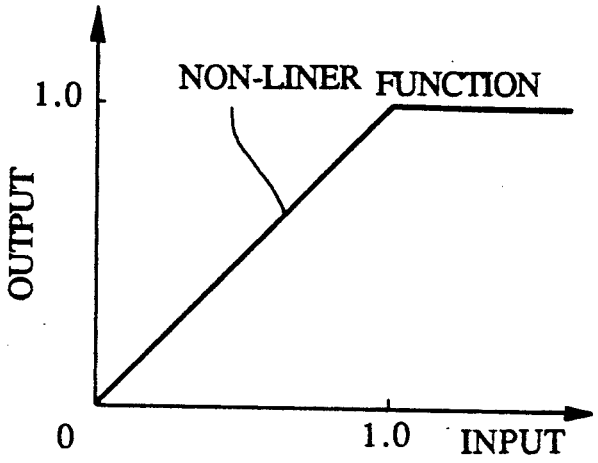
FIG. 2 is a waveform diagram which illustrates a non-linear function stored in ROM which is employed in the embodiment of the present invention shown in FIG. 1.

Since the envelope EL is equal to 0 at time t0, the output signal NL of ROM 3, which memorizes the non-linear function shown in FIG. 2, also becomes 0. Thus, the output signal at point B also becomes 0 (see time t0 in FIG. 4(*b*)). Then, since the multiplication coefficient $\gamma$ (=0.2) is added by the adder 8, the final output of this musical tone control device 1, namely the envelope P, becomes 0.2 (see time t0 in FIG. 4(*c*)).

Then, when the envelope EL becomes 0.25 at time t1, the output signal NL of ROM 3 becomes 0.25. Then, the above output signal NL is multiplied by the multiplication coefficient $-\gamma$ (= −0.2) and the output signal NL1 becomes −0.05 by the multiplier 5. Then, the output signal NL1 is added to the envelope EL by the adder 7 and then the output signal NL2 becomes 0.2 (see time t1 in FIG. 4(*b*)). Also, multiplication coefficient $\gamma$ is added by the adder 8 and then the envelope P becomes 0.4. On the other hand, the output signal NL is multiplied by multiplication coefficient $\beta$ and the feedback FB (=0.25) is supplied to the adder 2 (see time t1 in FIG. 4(*c*)).

Then, when the envelope EL reaches 0.5 at time t2, the feedback FB described above is added by the adder 2. Thus, the output of the adder 2 becomes 0.75 and the output signal NL of ROM 3 also becomes 0.75. Then the above the multiplier 5 multiplies the output signal NL by multiplication coefficient $-\gamma$ and the output signal NL1 reaches $-0.15$. Then, the output NL1 and envelope EL are added by the adder 7 and the output signal NL becomes 0.35 (see time t2 in FIG. 4(*b*)). Further, multiplication coefficient $\gamma$ is added by the adder 8 and the envelope P becomes 0.55 (see time t2 in FIG. 4(*b*)).

On the other hand, the output signal NL is multiplied by multiplication coefficient $\beta$, which is fed back to the adder 2.

Then, when the envelope EL reaches 0.75 at time t3, the above feedback FB is added, thus enabling the output of the adder 2 to be equal to 1.0 and the output signal NL of ROM 3 to be equal to 1.0. Then, multiplier 5 multiplies the above output signal NL by multiplication coefficient $-\gamma$ and the output signal NL1 becomes $-0.2$. Then, the output signal NL1 and the envelope EL are added by the adder 7 and the output signal NL2 becomes 0.55 (see time t3 in FIG. 4(*b*)). Further, multiplication coefficient $\gamma$ is added by the adder 8 and then the final envelope P becomes 0.75 (see time t3 in FIG. 4(*c*)). On the other hand, the output signal NL is multiplied by multiplication coefficient $\beta$, which is fed back to the adder 2.

Then, when the envelope EL reaches 1.0 at times t1–t7, the above feedback FB is added by the adder 2. Thus, the output of the adder 2 during this period exceeds 1.0. However, since the ROM 3 has a non-linear function, as shown in FIG. 2, the output signal NL remains at 1.0. Then, the above output signal NL is multiplied by multiplication coefficient $-\gamma$ by the multiplier 5 and the output signal NL1 becomes $-0.2$ between times t4–t7 (see FIG. 4(*b*)). Then, the output signal NL1 and the envelope EL are added by the adder 7 and the output signal NL2 becomes 0.8 between times t4–t7. Further, the multiplication coefficient is added by The adder 8 and then the envelope P becomes 1.0 (see times t4–t7 in FIG. 4(*c*)).

On the other hand, the output signal NL is multiplied by multiplication coefficient $\beta$, which is fed back to the adder 2.

Then, when the envelope EL reaches 0.5 at time t8, the above feedback FB is added by the adder 2 and the output of the adder 2 becomes 1.5. The output signal NL of ROM 3 remains at 1.0. Then, the above output signal NL is multiplied by multiplication coefficient $-\gamma$ by the multiplier 5 and the output signal NL1 reaches $-0.2$. Then, the output signal NL1 and the envelope EL area added by the adder 7 and the output signal NL2 becomes 0.3 (see time t8 in FIG. 4(*b*)). Further, multiplication coefficient $\gamma$ is added by the adder 8 and the envelope P becomes 0.5 (see time t8 in FIG. 4(*c*)). On the other hand, the output signal NL is multiplied by the multiplication coefficient $\beta$, which is fed back to the adder 2.

Then, when the envelope EL becomes 0 at time t9, the above feedback FB is added by the adder 2 and the output of the adder 2 becomes 1.0. The output signal NL of ROM 3 remains at 1.0. Then, the above output signal NL is multiplied by multiplication coefficient $-\gamma$ by the multiplier 5 and the output signal LN1 becomes $-0.2$ (see time t9 in FIG. 4(*b*)). Then, the output signal NL1 and the envelope EL are added by the adder 7 and the output signal NL2 becomes $-0.2$. Also, multiplication coefficient $\gamma$ is added by the adder 8 and the pressure P becomes 0 (see time t9 in FIG. 4(*c*)).

Figure 4A:
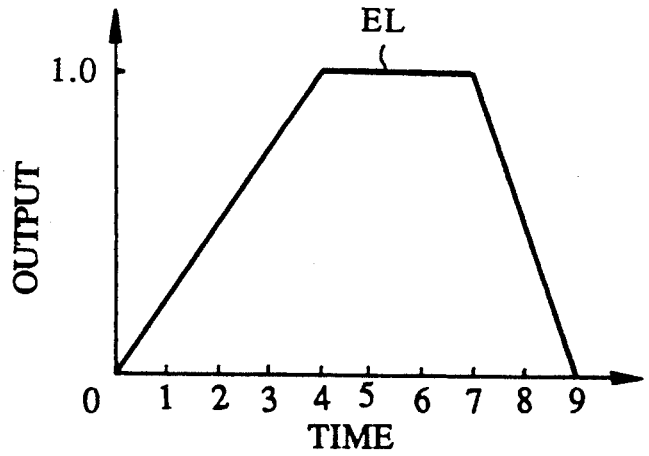
FIGS. 4(*a*), 4(*b*), and 4(*c*) are waveform diagrams illustrating waveforms employed in the embodiment of the present invention shown in FIG. 1.
Figure 4B:
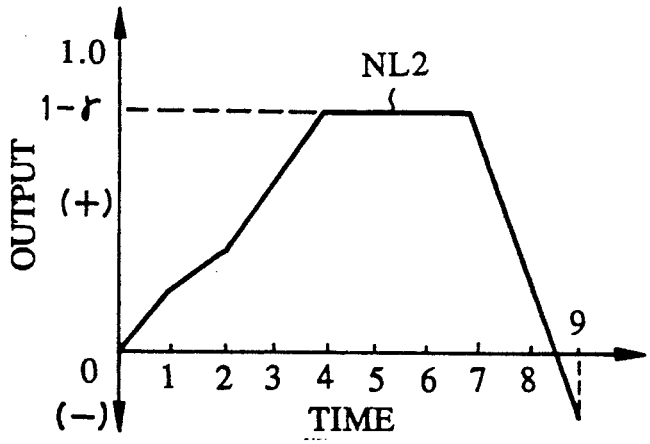
Figure 4C:
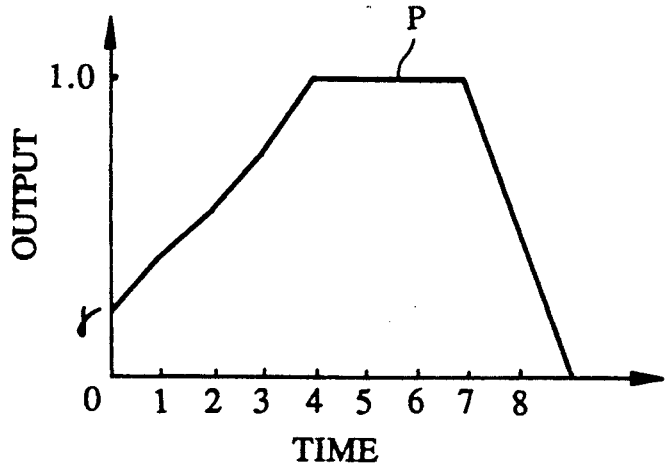

As in the above, this musical tone control device 1 outputs the envelope EL shown in FIG. 4(*a*) to the musical tone synthesizer (tone module), which is not illustrated, as the envelope P shown in FIG. 4(*c*) with the specified output level. The musical tone synthesizer controls the sound volume of the musical tone according to the envelope P.

Figure 5:
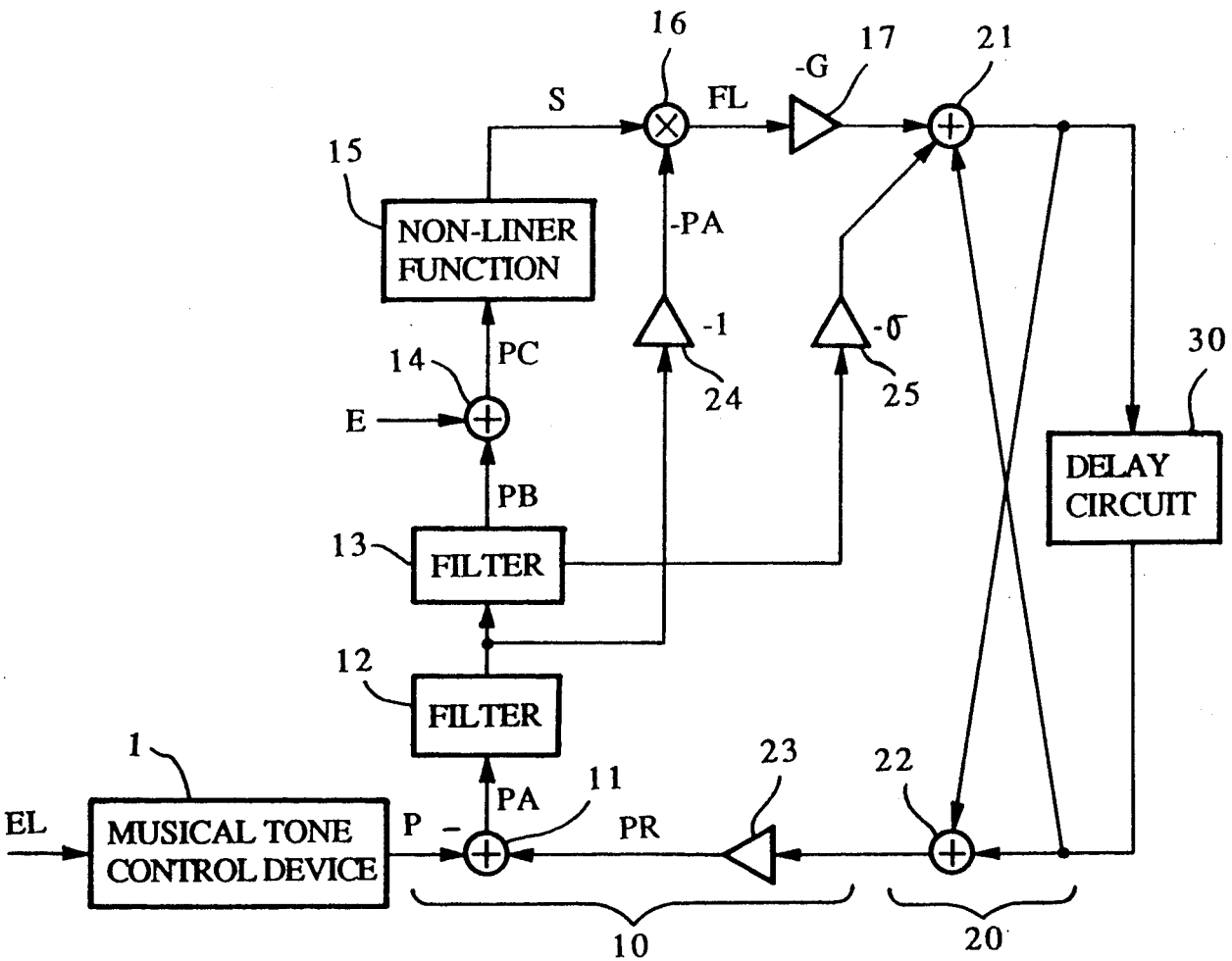
FIG. 5 is a block diagram showing the composition of the embodiment of the present invention as applied to simulation of a wind instrument.
Figure 6A:
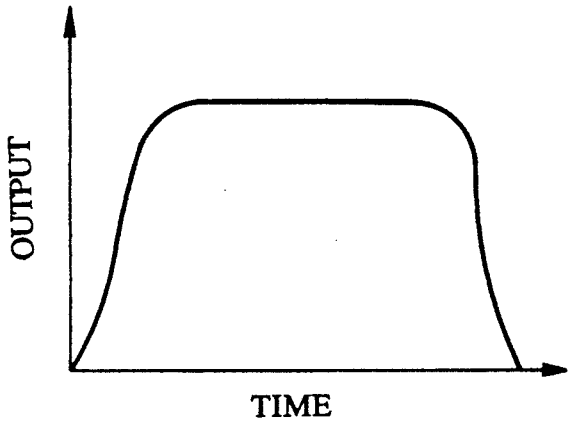
FIG.6(a) (Prior Art)
FIG. 6(*a*) shows a generic envelope used for controlling the volume of a typical musical tone and FIG. 6(*b*) shows an envelope used for controlling the volume of a musical tone simulating a wind instrument.
Figure 6B:
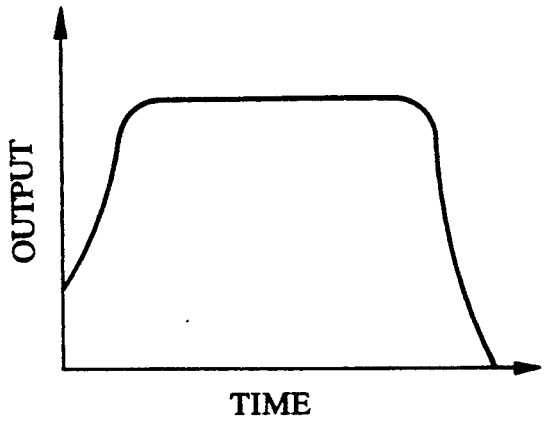
FIG.6(b) (Prior Art)

The following describes a sample application of the above musical tone control device 1 by referring to the block diagram shown in FIG. 5. In this figure, the entire figure shows the application of the musical tone control device 1 to a musical tone synthesizer that synthesizes the musical tone of a wind instrument, e.g., a reed instrument. This musical tone synthesizer consists of an excitation circuit 10 which simulates the operation of the mouthpiece of the wind instrument and a delay circuit 30 which simulates the resonance of a pipe musical instrument by means of a junction 20.

The excitation circuit 10 simulates the mouthpiece part of a single-read instrument. The following describes the mouthpiece part of a conventional non-electronic musical instrument. First of all, air flow (breathing) flows into the mouthpiece through a gap formed by the mouthpiece and the reed part when blowing an instrument. As a result, the air pressure within the mouthpiece changes, and this change in pressure is propagated as a pressure advance wave toward the resonant part of the pipe. Then, the pressure wave reflected by each part of the resonant pipe returns to the mouthpiece as a reflection of the pressure wave.

Also, force corresponding to the pressure difference between the inner pressure at the mouthpiece and the blowing pressure operates on the reed part. In addition to the above pressure difference, (a value related to the pressure generated when a blower holds the mouthpiece in his mouth) is applied to the reed part, and the reed part is bent by the total pressure, thus changing the gap between this reed part and the mouthpiece. In this case, the relationship between the total pressure applied to the reed part and the gap is approximated, for example, by a non-linear function (such as a second-order function) and is memorized as a table in the ROM 15 to be described later.

Also, when the reed part deviates and the gap changes, the airflow into the mouthpiece cases, i.e., the admittance of airflow changes and air is thus forced to move in accordance with the movement of the reed part, thus resulting in a change in air pressure. In this manner, the air pressure changes within the mouthpiece, the reciprocating motion of the advance pressure wave and the reflection pressure wave within the resonant pipe are maintained, and the inside of the resonant pipe becomes resonant, thus generating a musical tone.

The excitation circuit 10 in FIG. 5 faithfully simulates the operation of the reed part at the mouthpiece as described above. The envelope P, which is equivalent to the blowing pressure, and E, which is equivalent to embouchure are supplied to this excitation circuit 10.

Then, the junction 20 simulates the scattering of air pressure at the mouthpiece of a wind instrument, and at the connection part of a resonant pipe. In this junction 20, the output signal from the delay circuit 30 and that of the excitation circuit 10 are added by the adder 21 and fed to the delay circuit 30. Also, the output signal of the adder 21 and that of the resonant circuit 30 are added by the adder 22 and fed to the excitation circuit 10 through the multiplier 23.

Then, the delay circuit 30 is operated by means of a delay device such as a shift register. After this delay circuit 30 delays the output signal of the excitation circuit 10, which is supplied through the junction 20 by a specified amount of time, the signal is fed back to the excitation circuit 10 through the junction 20. In this case, the primary resonant frequency of a musical tone is determined by the time required when a signal reciprocates between the excitation circuit 10 and the delay circuit 30. In this musical tone synthesizer, the delay time of the delay circuit 30 is controlled by the control device (which is not illustrated), thus enabling the tone frequency to be controlled.

Then, the signal PR, which is equivalent to the air pressure of a reflection wave from a resonant pipe through the junction 20 and multiplier 23 from the delay circuit 30, and the envelope P, which is equivalent to the blowing pressure from the musical tone control device 1 are supplied to the subtracter 11 within the excitation circuit 10. This subtracter 11 outputs the output signal PA, which is equivalent to the pressure difference between the inner pressure and the blowing pressure from the mouthpiece to the filter 12.

The filter 12 is output to the filter 13 after eliminating high-frequency elements and is output to the multiplier 16 through the multiplier 24. The multiplier 24 multiplies the output signal PA by $-1$.

Then, the filter 13 extracts low-frequency and high-frequency constituents of the input signal and has a low-pass filter and high-pass filter for outputting each constituent. The IIR filter (a non-recursive digital filter) is well known as a filter which is provided with this type of low-pass and high-pass filter function. The pass output is supplied to the adder 14 as the output signal PB. Also, the high-pass output is supplied to the adder 21 through the multiplier 25. The multiplier 25 uses multiplication coefficient $-\alpha$.

Then, the adder 14 adds the above E to the above output signal PB, obtains the total pressure actually added to the reed part, and then outputs it to the ROM 15 as the output signal PC. The above non-linear function is memorized by the ROM 15 as a table, and the signal S, which is equivalent to the gap between the reed part and the mouthpiece is output to the multiplier 16. The multiplier 16 multiplies the output signal S by the output signal $-$PA, obtains the flow rate of air flowing into the mouthpiece, and then outputs the signal to the multiplier 17 as the flow rate signal FL. The multiplier 17 multiplies the flow rate signal F by the multiplication coefficient $-$G and then outputs it to the adder 21.

The adder 21 adds the calculation results obtained by multiplying the high-pass output of the filter 13 by the multiplication constant $\alpha$, namely the flow rate signal $-$G·FL to the output signal of the delay circuit 30 and then outputs it to the delay circuit 30 as described above.

In the above configuration, when the envelope EL is supplied, the musical tone control device 1 generates a specified envelope P as described in the above and then feeds it to the subtracter 11. The excitation circuit 10 generates an excitation signal according to the above parameters. This excitation signal is then delayed by a specified duration by the delay circuit 30 and fed back to the excitation circuit 10 as the above output signal PR through the junction 20. In this manner, the envelope P output by the tone module control device 1 and the output signal PR are substracted by the subtracter 11 and then a musical tone generated by a wind instrument is faithfully synthesized by circulating an excitation signal in the following path: excitation circuit 10→junction 20→delay circuit 30→junction 20→excitation circuit 10.

Not only the sound volume but also other timbre information such as pitch may be controlled by the envelope P output by the musical tone control device 1 in the above example. Further, a plurality of timbre information may be simultaneously controlled.

It is not always necessary to set the envelope B shown in FIG. 3(*b*) to completely cancel the envelope A and it is possible to use hysteresis characteristics positively for creating timbre.

The musical tone control device 1 was realized by hardware in the above sample execution, but it can also be realized by computer programming.

In addition, it can be used for other synthesis algorithms, such as for string instruments as well as for wind instruments, in the same sample execution, and can also be used for controlling a system with a remarkable hysteresis, as in a machine system other than for musical tone synthesis.

It is also possible to use analog circuitry rather than digital circuitry in the same sample execution.

What is claimed is:

1. A musical tone generation device comprising:

a) control means for generating musical tone control signals, said musical tone control signals having increasing and decreasing values;

b) musical tone signal generating means for generating musical tone signals in response to said musical tone control signals, said musical tone signal generating means including a closed-loop means for circulating a signal thereto in response to said musical tone control signals, said closed-loop means further including a delay means for delaying said circulating signal, and said musical tone signal generating means having an input musical tone control signal versus output musical tone signal hysteresis characteristic which changes said generated musical tone signals dependent on said increasing and decreasing values of said musical tone control signals; and c) canceling means for canceling out said hysteresis characteristic of said musical tone signal generating means.

2. A musical tone generation device in accordance with claim 1, wherein said canceling means comprises conversion means for converting said musical tone control signals into converted control signals which nullify said hysteresis characteristic and thereby said musical tone signal generating means generates musical tone signals substantially devoid of said hysteresis characteristic.

3. A musical tone generation device in accordance with claim 2, wherein said conversion means stores a conversion table used to convert said musical tone control signals into said converted control signals.

4. A musical tone generation device in accordance with claim 3, wherein said conversion means stores a non-linear function as said conversion table.

5. A musical tone generation device in accordance with claim 1, wherein said musical tone generating means is a musical tone synthesizer in which said closed-loop means further comprises a closed-loop circuit incorporating a low-pass filter which simulates an acoustic delay, and said delay means further comprises a delay circuit which simulates a propagation delay of vibration in a conventional non-electronic musical instrument.

6. A musical tone generation device in accordance with claim 1, wherein said control means is an envelope generator and said musical tone control signals are envelope patterns generated by said envelope generator.

7. A musical tone generation device in accordance with claim 1, wherein said canceling means is capable of nullifying a hysteresis characteristic relating to increasing and decreasing values of tone volume in said generated musical tone signals.

8. A musical tone generation device in accordance with claim 1, wherein said canceling means is capable of nullifying a hysteresis characteristic relating to increasing and decreasing values of tone color in said generated musical tone signals.

9. A musical tone generation device in accordance with claim 1, wherein said canceling means is capable of nullifying a hysteresis characteristic relating to increasing and decreasing values of tone pitch and a hysteresis characteristic relating to increasing and decreasing values of tone volume in said musical tone signals.

10. A musical tone generation device in accordance with claim 2, wherein said conversion means consists of a digital circuit.

11. A musical tone generation device in accordance with claim 2, wherein said conversion means consists of an analog circuit.

* * * * *